United States Patent [19]

Mashiach

[11] Patent Number: 4,761,139

[45] Date of Patent: Aug. 2, 1988

[54] DRAWING BOARD TYPE AMUSEMENT DEVICE

[76] Inventor: Gideon Mashiach, Mendeli Street 4, Rehovot, Israel

[21] Appl. No.: 867,019

[22] Filed: May 27, 1986

[30] Foreign Application Priority Data

Jun. 18, 1985 [IL] Israel ..... 75550

[51] Int. Cl.[4] ..... B43L 1/12

[52] U.S. Cl. ..... 434/410; 434/426

[58] Field of Search ..... 434/410–413, 434/430, 433, 365, 85, 88, 258, 261, 426

[56] References Cited

U.S. PATENT DOCUMENTS

| | | | |
|---|---|---|---|
| 611,545 | 9/1898 | Yarnall | 434/88 |
| 1,891,414 | 12/1932 | Hahn | 434/410 |
| 3,279,100 | 10/1966 | Knott | 434/410 |
| 3,284,924 | 11/1966 | Parmenter | 434/349 |
| 3,497,970 | 3/1970 | Padowicz | 434/410 |
| 4,208,809 | 6/1980 | Schwartz | 434/308 |
| 4,427,387 | 1/1984 | Tomita | 434/88 |

FOREIGN PATENT DOCUMENTS

| | | | |
|---|---|---|---|
| 601374 | 2/1960 | Italy | 434/410 |
| 5579 | of 1899 | United Kingdom | 434/412 |
| 18729 | of 1907 | United Kingdom | 434/412 |

*Primary Examiner*—John E. Murtagh
*Assistant Examiner*—Andrew Joseph Rudy
*Attorney, Agent, or Firm*—Benjamin J. Barish

[57] ABSTRACT

A drawing board type amusement device, comprises a rigid board, a backing sheet overlying the board, and a masking member overlying the backing sheet and including a masking layer of opaque material which flows under the localized pressure of a stylus or finger to expose the underlying backing sheet along the areas in which the localized pressure is applied. The backing sheet is of longer length than the rigid board and is wound between a pair of rotatable spools at the ends of the board to permit different sections of the sheet to be aligned with the masking member.

19 Claims, 1 Drawing Sheet

FIG. 1
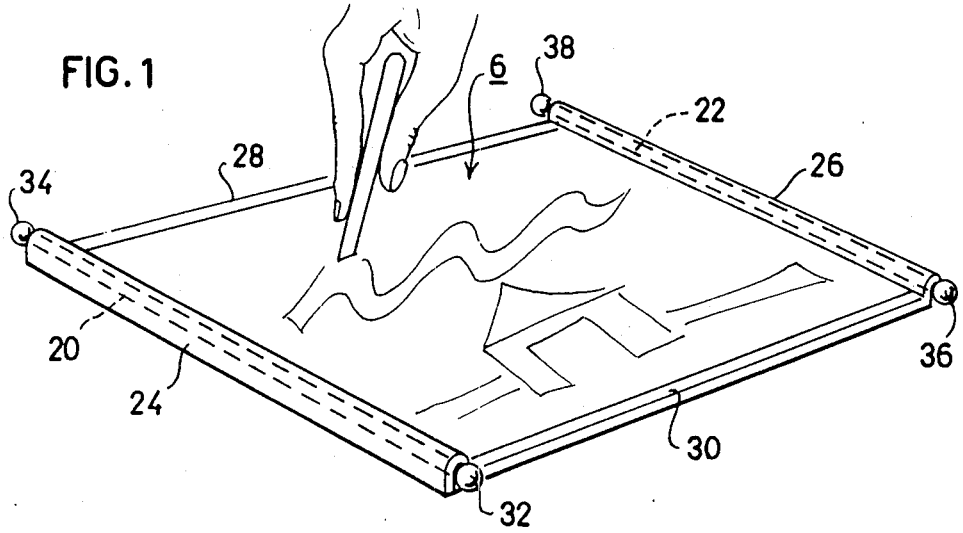
FIG. 2
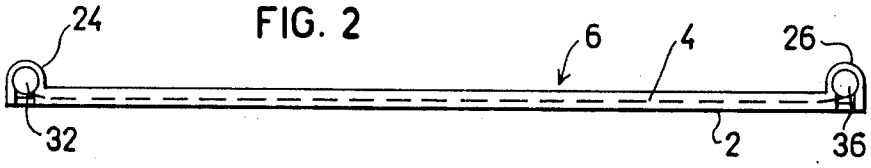
FIG. 3
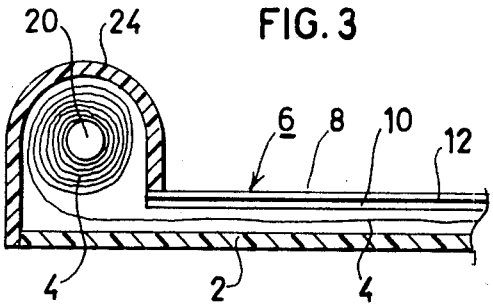
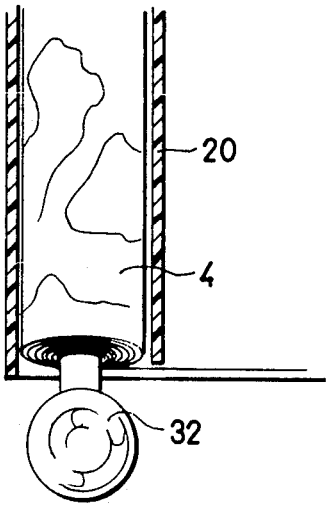
FIG. 4

DRAWING BOARD TYPE AMUSEMENT DEVICE

BACKGROUND OF THE INVENTION

The present invention relates to a drawing board type amusement device, and particularly to a drawing board for use by children in enabling them to draw different objects without paints or crayons.

One known drawing board of this type includes a rigid board, a backing sheet overlying the board, and a masking member overlying the backing sheet and including a masking layer of opaque material which flows under localized pressure of a stylus or finger to expose the underlying backing sheet along the areas in which the localized pressure is applied. Such drawing boards have become quite popular with children from the ages of 3–10 years, in that it enables them to use a stylus or their finger for drawing various objects without paints, crayons or other marking devices. In order to erase the object drawn, it is only necessary to pass the flat side of the stylus backwards and forwards over the masking sheet material while applying light pressure thereto, whereby the opaque masking material is caused to flow back to fill the space exposed by the localized marking pressure.

An object of the present invention is to provide an improved drawing board of the above type.

BRIEF SUMMARY OF THE INVENTION

According to the present invention, there is provided a drawing board type amusement device as described above characterized in that the backing sheet underlying the masking member is of longer length than the rigid board and is wound between a pair of rotatable spools at the ends of the board to permit different sections of the sheet to be aligned with the masking member.

Thus, the backing sheet may include different colors on different sections thereof to permit objects of different colors to be drawn. Preferably, the backing sheet is at least twice the length of the rigid board so that two completely different sections of the backiing sheet may be disposed to underly the masking member, with each section having a different color or combination of colors. This adds a new dimension of color possibilities that may be drawn on the board.

Further features and advantages of the invention will be apparent from the description below.

BRIEF DESCRIPTION OF THE DRAWINGS

The invention is herein described, by way of example only, with reference to the accompanying drawings, wherein:

FIG. 1 illustrates one form of drawing board type amusement device constructed in accordance with the present invention;

FIG. 2 is a side elevational view of the device of FIG. 1;

FIG. 3 is an enlarged sectional view along lines III—III of FIG. 1; and

FIG. 4 an enlarged fragmentary view, partly in section, more particularly illustrating the construction of one of the spools on which the backing sheet is wound.

DESCRIPTION OF A PREFERRED EMBODIMENT

The drawing board illustrated in the drawings comprises a rigid board 2, preferably of cardboard or plastic material, of rectangular configuration; a backing sheet 4 overlying the board 2; and a masking member, generally designated 6, overlying the backing sheet. The masking member 6 is of a known construction presently used in boards of this type. It comprises a pair of transparent, pliable sheets 8, 10 sealed to each other along their peripheries, and a pressure-flowable opaque material 12, such as a viscous oil, paste or wax, between the sealed transparent sheets 8, 10. As known in such devices, the opaque material 12 flows under a localized marking pressure, such as applied by a stylus or by the user's finger, to expose the underlying backing sheet 4 along the areas in which the localized pressure is applied. The backing sheet 4 is colored, usually by a plurality of different colors at different areas thereof, so that the color of the backing sheet is viewed along the lines of the marking pressure.

Thus, various objects of different colors can be drawn by merely tracing the desired pattern with a stylus or by the user's finger. The drawn pattern can be simply erased by merely pressing a flat object, such as the flat side of the stylus, backwards and forwards over the masking member 6, while applying a light pressure thereto, to redistribute the flowable opaque material 12 within the masking member, and thereby to completely re-mask the backing sheet 4.

As indicated earlier, such devices are known and in widespread use, and therefore further details of their construction or operation are not set forth herein.

According to the present invention, the backing sheet 4 is of longer length than the rigid board 2 and is wound between a pair of rotatable spools 20, 22 at the ends of the board to permit different sections of the backing sheet 4 to be aligned with the masking member 6. Thus, by providing different colors, or different color combinations, on different parts of the backing sheet 4, the objects or other markings drawn on the board will be of different colors depending on the section of the backing sheet 4 aligned with the masking member 6.

The rigid board 2 includes a rectangular frame circumscribing the masking member 6 and the underlying section of the backing sheet 4. The rectangular frame may also be made of plastic material and includes a pair of end frame sections 24, 26, upper frame section 28, and bottom frame section 30. The rotatable spools 20, 22 are disposed within the end frame sections 24, 26, which frame sections are hollowed, and are higher than the top and bottom frame sections 28, 30, to accomodate the spools. The inner ends of the frame sections engage, or are bonded to, the outer edges of the masking member 6 to anchor it in place. However, the frame sections do not immobilize the backing sheet 4, but permit the backing sheet to be moved with respect to the frame and the masking member 6, as described below.

Each spool includes a pair of finger-gripping knobs fixed to the opposite ends of the spool and projecting exteriorly of their respective frame sections to permit the user to rotate the spool and thereby to change the section of the backing sheet 4 in alignment with the masking member 6. Thus, the left-hand spool 20 includes two knobs 32, 34 at its opposite ends, and similarly the right-hand spool 26 includes two knobs 36, 38 at its opposite ends. These knobs are preferably of spherical configuration integrally formed with their respective spools.

The device illustrated in the drawings may be used as follows:

The two spools 20, 22 are first manipulated so that a desired section of backing sheet 4 is aligned with the masking member 6. The so aligned section of backing sheet 4 is provided with any desired color or arrangement of colors. Thus, when the user applies pressure by a stylus or by his finger to the upper face of the masking member 6, the opaque flowable material 12 within that member will part and thereby expose the color of the underlying backing sheet 4 along the areas in which marking pressure was applied. In this manner, various objects, having the color of the exposed portions of the underlying backing sheet 4, can be drawn on the board without the use of paint, crayons or other conventional marking materials. As indicated earlier, such markings can be erased by merely lightly pressing the flat side of the stylus backwards and forwards over the masking member 6 to redistribute the flowable opaque material 12 to completely mask the backing sheet 4.

Whenever it is desired to change the color or the color pattern of the objects drawn on the board, this may easily be done by rotating spools 20, 22 in order to align a different section of the backing sheet 4 under the masking member 6. A new colored section of the backing sheet 4 is thus positioned under the masking member 6, and a new color or combination of colors will be seen when drawings or other markings are made to the masking member as described above.

While the invention has been described with respect to one preferred embodiment, it will be appreciated that many other variations, modifications and applications of the invention may be made.

What is claimed is:

1. A drawing board type amusement device, comprising a rigid board, a backing sheet overlying the board, and a masking member overlying the backing sheet and including a masking layer of opaque material which flows under localized pressure of a stylus or finger to expose the backing sheet along areas in which the localized pressure is applied; characterized in that said backing sheet is of longer length than said rigid board and is wound between a pair of rotatable spools at opposite ends of the board to permit different sections of the sheet to be aligned with said masking member.

2. The device according to claim 1, wherein said backing sheet is at least twice as long as said board to permit at least two completely different sections of the sheet to be disposed under said masking member.

3. The device according to claim 1, wherein said backing sheet includes different colors on different sections thereof to permit objects of different colors to be drawn.

4. The device according to claim 1, wherein said rigid board includes a rectangular frame circumscribing said masking member and the underlying section of said backing sheet, said spools being disposed within opposite ends of said rectangular frame.

5. The device according to claim 4, wherein each of said spools includes at least one finger-gripping knob projecting from the frame for manipulation by the user.

6. The device according to claim 5, wherein each spool includes two finger-gripping knobs at the opposite ends thereof.

7. The device according to claim 1, wherein said masking member comprises a pair of transparent sheets sealed to each other along their peripheries, and a pressure-flowable opaque material between said sealed sheets.

8. A drawing board type amusement device, comprising a rigid board, a backing sheet overlying the board, and a masking member overlying the backing sheet and including a masking layer of opaque material which flows under localized pressure of a stylus or finger to expose the backing sheet along areas in which the localized pressure is applied; said backing sheet being of longer length than said rigid board and being wound between a pair of rotatable spools at opposite ends of the board to permit different sections of the sheet to be aligned with said masking member; said backing sheet including different color on different sections thereof to permit objects of different colors to be drawn.

9. The device according to claim 8, wherein said backing sheet is at least twice as long as said board to permit at least two completely different sections of the sheet to be disposed under said masking member.

10. The device according to claim 8, wherein said rigid board includes a rectangular frame circumscribing said masking member and the underlying section of said backing sheet, said spools being disposed within opposite ends of said rectangular frame.

11. The device according to claim 10, wherein each of said spools includes at least one finger-gripping knob projecting from the frame for manipulation by the user.

12. The device according to claim 11, wherein each spool includes two finger-gripping knobs at the opposite ends thereof.

13. The device according to claim 8, wherein said masking member comprises a pair of transparent sheets sealed to each other along their peripheries, and a pressure-flowable opaque material between said sealed sheets.

14. A drawing board type amusement device, comprising a rigid board, a backing sheet overlying the board, and a masking member overlying the backing sheet and including a masking layer of opaque material which flows under localized pressure of a stylus or finger to expose the backing sheet along areas in which the localized pressure is applied; said masking member comprising a pair of transparent sheets sealed to each other along their peripheries, and a pressure-flowable opaque material between said sealed sheets; said backing sheet being of longer length than said rigid board and being wound between a pair of rotatable spools at opposite ends of the board to permit different sections of the sheet to be aligned with said masking member.

15. The device according to claim 14, wherein said backing sheet is at least twice as long as said board to permit at least two completely different sections of the sheet to be disposed under said masking member.

16. The device according to claim 14, wherein said backing sheet includes different colors on different sections thereof to permit objects of different colors to be drawn.

17. The device according to claim 14, wherein said rigid board includes a rectangular frame circumscribing said masking member and the underlying section of said backing sheet, said spools being disposed within opposite ends of said rectangular frame.

18. The device according to claim 17, wherein each of said spools includes at least one finger-gripping knob projecting from the frame for manipulation by the user.

19. The device according to claim 18, wherein each spool includes two finger-gripping knobs at the opposite ends thereof.

* * * * *